US010138652B2

(12) United States Patent
Huang

(10) Patent No.: US 10,138,652 B2
(45) Date of Patent: Nov. 27, 2018

(54) FOLDABLE TENT RACK

(71) Applicant: XIAMEN ROADZUP OUTDOOR PRODUCTS CO., LTD., Xiamen, Fujian (CN)

(72) Inventor: Changjiu Huang, Fujian (CN)

(73) Assignee: XIAMEN ROADZUP OUTDOOR PRODUCTS CO., LTD., Xiamen (CN)

( * ) Notice: Subject to any disclaimer, the term of this patent is extended or adjusted under 35 U.S.C. 154(b) by 7 days.

(21) Appl. No.: 15/392,991

(22) Filed: Dec. 28, 2016

(65) Prior Publication Data

US 2017/0191285 A1 Jul. 6, 2017

(30) Foreign Application Priority Data

Dec. 30, 2015 (CN) ..... 2015 1 1020497

(51) Int. Cl.

| | |
|---|---|
| ***E04H 15/46*** | (2006.01) |
| ***E04H 15/40*** | (2006.01) |
| ***E04H 15/48*** | (2006.01) |
| *E04H 15/42* | (2006.01) |

(52) U.S. Cl.

CPC ..... *E04H 15/405* (2013.01); *E04H 15/46* (2013.01); *E04H 15/48* (2013.01); *E04H 15/425* (2013.01)

(58) Field of Classification Search

CPC ..... E04H 15/50; E04H 15/34; E04H 15/46; E04H 15/48; E04H 15/36; E04H 15/42; E04H 15/505; E04H 15/425

USPC ..... 135/121, 97, 124, 138, 139, 141–145, 135/156, 120.1–120.3, 126, 131

See application file for complete search history.

(56) References Cited

U.S. PATENT DOCUMENTS

| | | | | |
|---|---|---|---|---|
| 4,285,355 | A * | 8/1981 | Lundblade | E04H 15/42 135/147 |
| 4,706,696 | A * | 11/1987 | Gillis | E04H 15/425 135/127 |
| 8,910,648 | B2 * | 12/2014 | Jin | E04H 15/48 135/114 |
| 9,140,030 | B2 * | 9/2015 | Jin | E04H 15/46 |
| 9,366,054 | B2 * | 6/2016 | Li | E04H 15/48 |
| 9,732,539 | B2 * | 8/2017 | Kim | E04H 15/46 |
| 2012/0186618 | A1 * | 7/2012 | Arredondo | E04H 15/42 135/96 |
| 2014/0311540 | A1 * | 10/2014 | Choi | E04H 15/42 135/143 |

(Continued)

FOREIGN PATENT DOCUMENTS

CN 104278883 A 1/2015

*Primary Examiner* — Winnie Yip

(74) *Attorney, Agent, or Firm* — Rabin & Berdo, P.C.

(57) ABSTRACT

A foldable tent rack includes a first support stand including a first connecting base, two first stand poles, and two second stand poles; and a second support stand including a third stand pole, a second connecting base, and the second stand pole. Each first stand pole is rotatably connected to the first connecting base. Each first stand pole is rotatably connected to one second stand pole to form a scissor-type structure. First ends of the second and third stand poles are rotatably connected by the second connecting base. The second and third stand poles are rotatable. The third stand pole is rotatably connected to a fourth stand pole to form a scissor-type structure. In the unfolded position, arch shapes are formed and the poles are separated.

13 Claims, 6 Drawing Sheets

(56) References Cited

U.S. PATENT DOCUMENTS

| | | | | |
|---|---|---|---|---|
| 2015/0068573 | A1* | 3/2015 | Jin | E04H 15/42 135/147 |
| 2015/0090309 | A1* | 4/2015 | Ma | E04H 15/48 135/122 |
| 2016/0060897 | A1* | 3/2016 | Baoqing | E04H 15/60 135/146 |
| 2016/0281385 | A1* | 9/2016 | Choi | E04H 15/48 |
| 2016/0290001 | A1* | 10/2016 | Choi | E04H 15/48 |

* cited by examiner

FOLDABLE TENT RACK

FIELD OF THE INVENTION

The present invention relates to camping equipment, particularly to a tent rack.

BACKGROUND OF THE INVENTION

As disclosed in Chinese patent database with publishing number CN104278883A, as figured in FIG. 15, a foldable tent rack comprises two sets of scissor racks 10', the two sets of scissor racks 10' are connected, the end portion at the same side of two linking poles 11' of one set of scissor rack 10' are rotatably connected to the end portion at the same side of the two linking poles 11' of the other set of scissor rack 10'. The pivot base 13' is pivoted with a first support pole 20', the end portion at the other side of the linking pole 11' of the two sets of scissor rack 10' is also pivoted with a first support pole 20'. Therein, the two sets of scissor rack are connected to a parallelogram structure. On one hand, the relative rotation of the two linking poles of the scissor rack and the relative rotation of the two sets of scissor rack are interference, making the unfolding and folding needed to improve. The structure is more complicated. On the other hand, the two linking poles intersect in an angle smaller than 180°, as the pivot base needs a first support pole to support, the number of the poles is increased, so is the manufacturing cost. It is inconvenient to configure the door and window of the tent cloth, it is also inconvenient for user to get in and out of the tent.

SUMMARY OF THE INVENTION

The present invention is provided with a tent rack, which overcomes the disadvantages of the traditional tent rack.

The technical solution of the present invention is that:

A tent rack, wherein comprising a first support stand (10), the first support stand (10) comprises two first stand poles (11) and a first connecting base (12), the first end of the two first stand poles (11) are rotatably connected by the first connecting base (12), so that the two first stand poles (11) are rotatable between a folding position and a unfolding position, each of the first stand pole (11) is rotatably connected with a second stand pole (21), the first stand pole (11) and the second stand pole (21) couple to form a scissor-type structure (20), the first support stand (10) with two first stand poles (11) unfolded is arch shaped and the two second stand poles (21) are separated.

In another preferred embodiment, the rotating axis of the first stand pole (11) and the second stand pole (21) is not parallel to the rotating axis of the two first stand poles (11).

In another preferred embodiment, the rotating axis of the two first stand poles (11) is vertically arranged when the two first stand poles (11) are in the unfolding position.

In another preferred embodiment, the rotating axis of the two first stand poles (11) is laterally arranged when the two first stand poles (11) are in the unfolding position.

In another preferred embodiment, the first end of the second stand pole (21) is suspending.

In another preferred embodiment, the second end of the first stand pole (11) and the second end of the second stand pole (21) are rotatably connected with a leg pole (40) by a connecting members (30).

In another preferred embodiment, further comprising a second support stand (50), the second support stand (50) comprises a third stand pole (51), a second connecting base (52) and said second stand pole (21); the first end of the third stand pole (51) and the first end of second stand pole (21) are rotatably connected by a second connecting base (52), the third stand pole (51) and the second stand pole (21) are rotatable between a unfolding position and a folding position, the third stand pole (51) is rotatably connected with a fourth stand pole (61), the third stand pole (51) and the fourth stand pole (61) couple to form a scissor-type structure (60), the second support stand (50) with the third stand pole (51) and the second stand pole (21) in the unfolding position is arch shaped and the first stand pole (11) and the fourth stand pole (61) are separated.

In another preferred embodiment, the first end of the fourth stand pole (61) is suspending.

In another preferred embodiment, the second end of the first stand pole (11), the second end of the support pole (21), the second end of the third stand pole (51) and the second end of the fourth stand pole (61) are rotatably connected with a leg pole (40) by a connecting member (30).

In another preferred embodiment, the leg pole (40) is a retractable pole.

Compared to the traditional technology, the present invention has following advantages:

1. The first support stand with the first stand poles are in the unfolding position is arch shaped and the two second stand poles are separated, the disadvantages of the traditional technology is overcame, the present invention has following advantages: firstly, the rotation of the two first stand poles and the rotation of the scissor-type structure are independent without inference, the arrangement is reasonable, the user can rotate the poles conveniently, the opening angle of the scissor-type structure is free that the tent can form in different shapes, the folding and unfolding are convenient and fast; secondly, the number of the poles are decreased, avoiding poles intervening the door and window of the tent and making the arrangement of the door and window convenient and the getting in and out of the tent conveniently for the user; thirdly, the first support stand with the first stand poles in unfolding position is arch shaped, the tent has high stability and strong support performance; fourthly, the structure is simple and easy for mass manufacturing.
2. The first end of the second stand pole is suspending that it is convenient to arrange the door and window of the tent.
3. The second support stand with the third stand pole and the second stand pole in the unfolding position is arch shaped and the first stand pole and the fourth stand pole are separated, the tent has high stability and strong support performance.

BRIEF DESCRIPTION OF THE DRAWINGS

The present invention will be further described with the drawings and the embodiments.

DETAILED DESCRIPTION OF THE EMBODIMENTS

Embodiment 1

Figure 1:
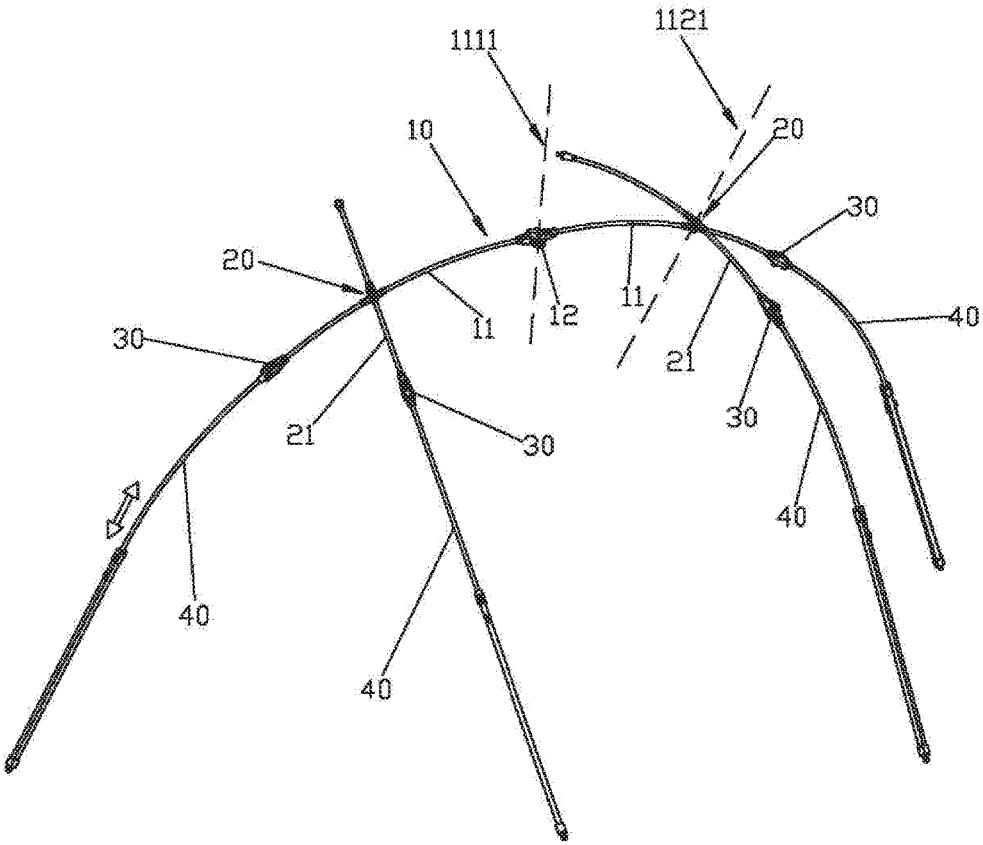
FIG. 1 illustrates a schematic diagram of a tent rack of Embodiment 1 of the present invention in unfolding state.

Referring to FIGS. 1-9, a tent rack comprises a first support stand 10, which comprises two first stand poles 11 and a first connecting base 12, the first end of the two first stand poles 11 are rotatably connected by the first connecting base 12, so that the two first stand poles 11 are rotatable between a folding position and a unfolding position, the central portion of the first stand pole 11 is rotatably connected with a second stand pole 21, the first stand pole 11 and the second stand pole 21 are coupled to from a scissor-type structure 20, the first support stand 10 is arc shaped and the two second stand poles 21 are separated when the two first stand poles are unfolded, the separation can be parallel arranged, the first end of the second stand poles 21 are suspending. Therein, the rotation between the two first stand poles and the rotation of the scissor-type structure are independent without interference. The opening angle of the scissor-type structure is not limited by the opening angle of the first support stand, the opening angle of the scissor-type structure is free. Preferred the first connecting base 12 is disposed with a keeping structure used to keep the two first stand poles 11 in unfolding position, the keeping structure is for example a lock mechanism 123, which locks the two first stand poles in unfolding position, such that the two first stand poles can be kept in unfolding position; when the lock mechanism is unlocked, the two first stand poles are rotatable. The first stand poles and the second stand poles can be elastic fibre poles or hard poles, the hard pole can be metal hard pole or plastic hard pole, The rotating axis of the first stand pole 11 and the second stand pole 21 is not parallel to the rotating axis of the two first stand poles 11. in this embodiment, the rotating axis of the two first stand poles 11 in unfolding position is vertical, so that the two first stand poles are rotatable in the horizontal direction; the two first stand poles can be open in 180° or more than 180° in the unfolding position, such to self lock.

Figure 2:
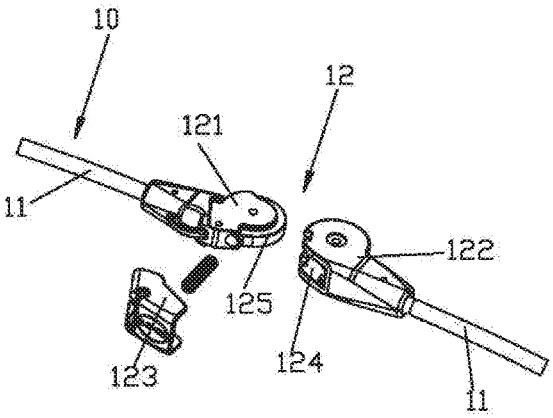
FIG. 2 illustrates an enlargement and exploded diagram of A portion of FIG. 1.

Referring to FIG. 2, in Embodiment 1, the first connecting base is a rotating joint, which comprises a first connecting head 121 fixedly connected to the first end of one first stand pole 11 and a second connecting head 122 fixedly connected to the first end of the other stand pole 11, the first connecting head 121 is rotatably connected to the second connecting head 122, making the two first stand poles rotatably connected; the rotatable connection of the first connecting head 121 and the second connecting head 122 is as that: the first connecting head 121 is disposed with a connecting groove 124, the second connecting head 122 is disposed with a lug 125, the lug 125 is inserted to the connecting groove 124, the lug is rotatably connected to the connecting groove by a pivot shaft. The first connecting base is disclosed in the Chinese patent database with publishing number CN103669992A.

The second end of the first stand pole 11 and the second end of the second stand pole 21 are respectively rotatably connected with a leg pole 40 by a connecting member 30. The tent rack is unfolded and the leg poles 40 are supported on the ground. The connecting member 30 is disposed with keeping structure to keep the stand poles 11 and the leg poles, the stand poles 21 and the leg poles 40 in unfolding position, the keeping structure is a lock mechanism for example, the connecting member 30 is as disclosed in the Chinese patent database with publishing number CN103669992A.

Figure 3:
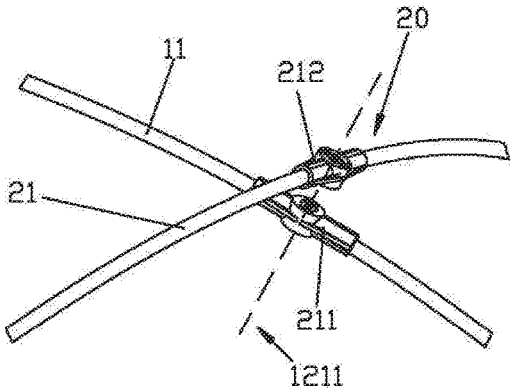
FIG. 3 illustrates an enlargement and exploded diagram of B portion of FIG. 1.
Figure 4:
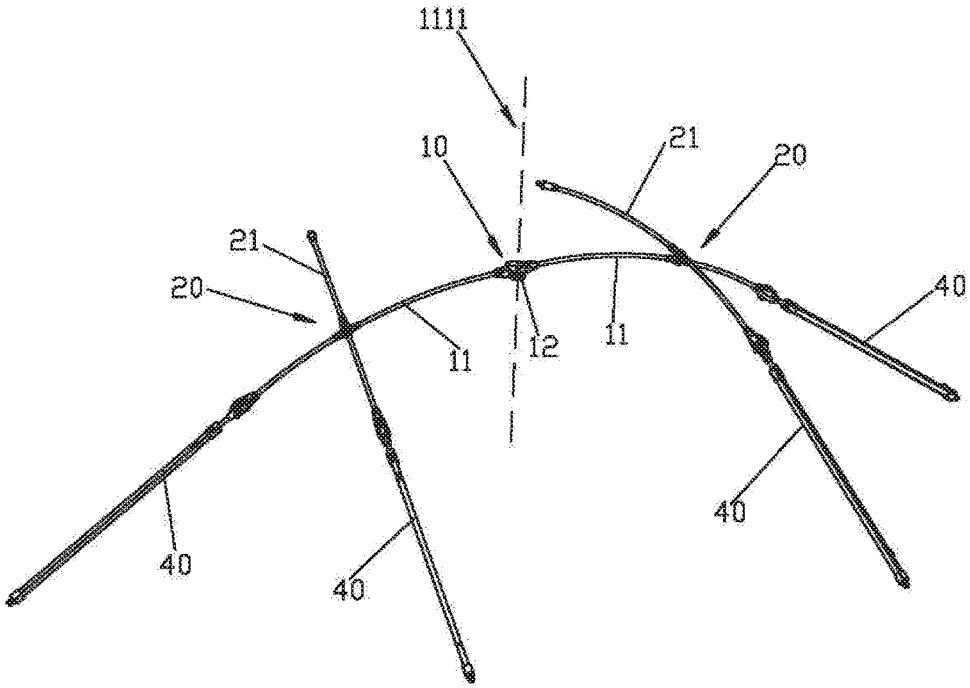
FIG. 4 illustrates a schematic diagram of the leg pole of the tent rack of Embodiment 1 in retracted state.
Figure 5:
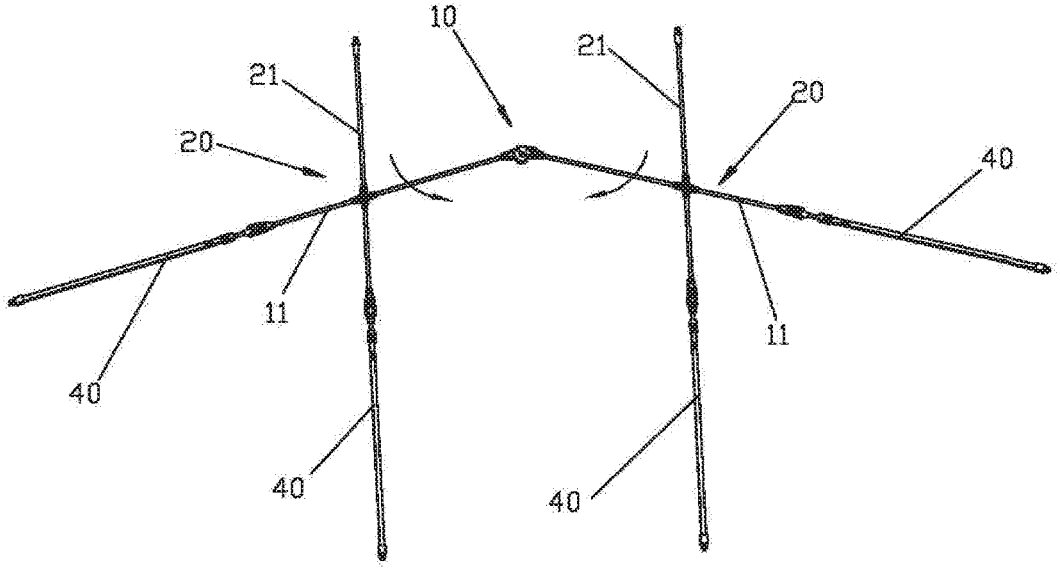
FIG. 5 illustrates a schematic diagram of the two first stand poles of the tent rack being rotated and folded of the Embodiment 1.
Figure 6:
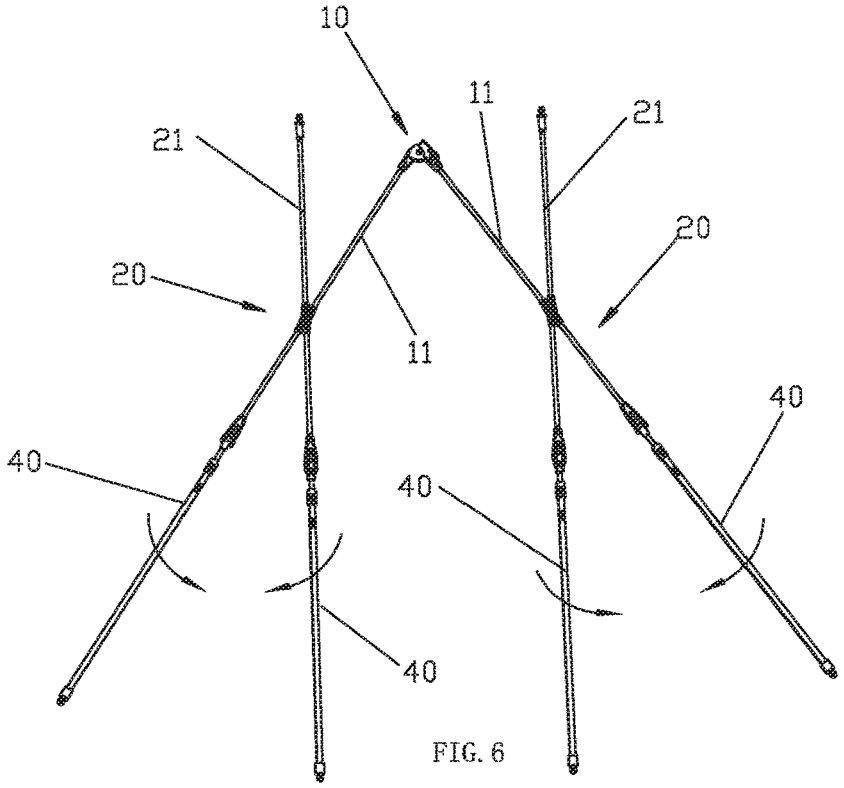
FIG. 6 illustrates a schematic diagram of the scissor-type structure being rotated and folded of the tent rack of Embodiment 1.
Figure 7:
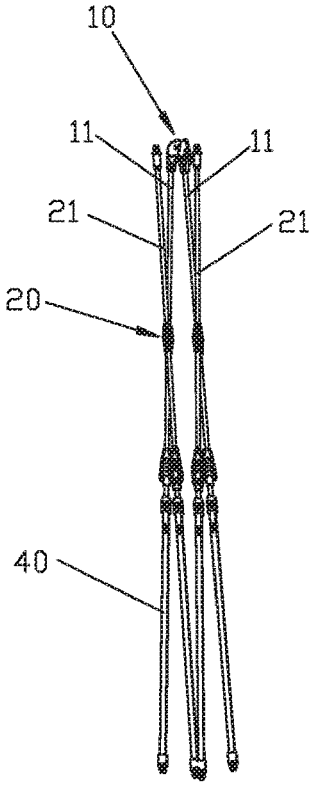
FIG. 7 illustrates a schematic diagram of the scissor-type structure in folding state of the tent rack of Embodiment 1.
Figure 8:
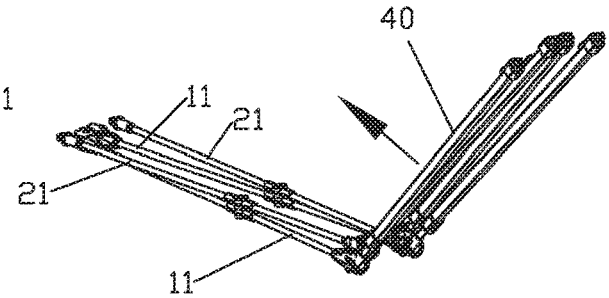
FIG. 8 illustrates a schematic diagram of the first stand pole and the leg pole of the tent rack being rotated and folded of Embodiment 1.
Figure 9:
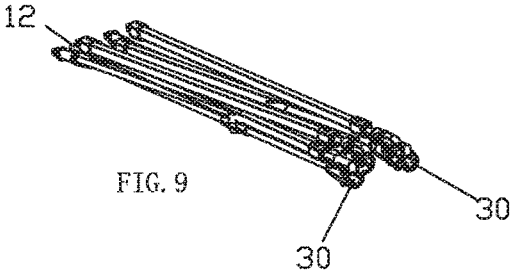
FIG. 9 illustrates a schematic diagram of the tent rack in folding state of Embodiment 1.

Referring to FIG. 3, a first fixing sleeve 211 is sleeved on the central portion of the first stand pole 11, a second fixing sleeve 212 is sleeved on the central portion of the second stand pole 21, the first fixing sleeve 211 and the second fixing sleeve 212 are connected by a pivot shaft passing through said two fixing sleeves, making the two fixing sleeves rotatably connected and the first stand pole and the second stand pole form scissor-type structure.

Figure 10:
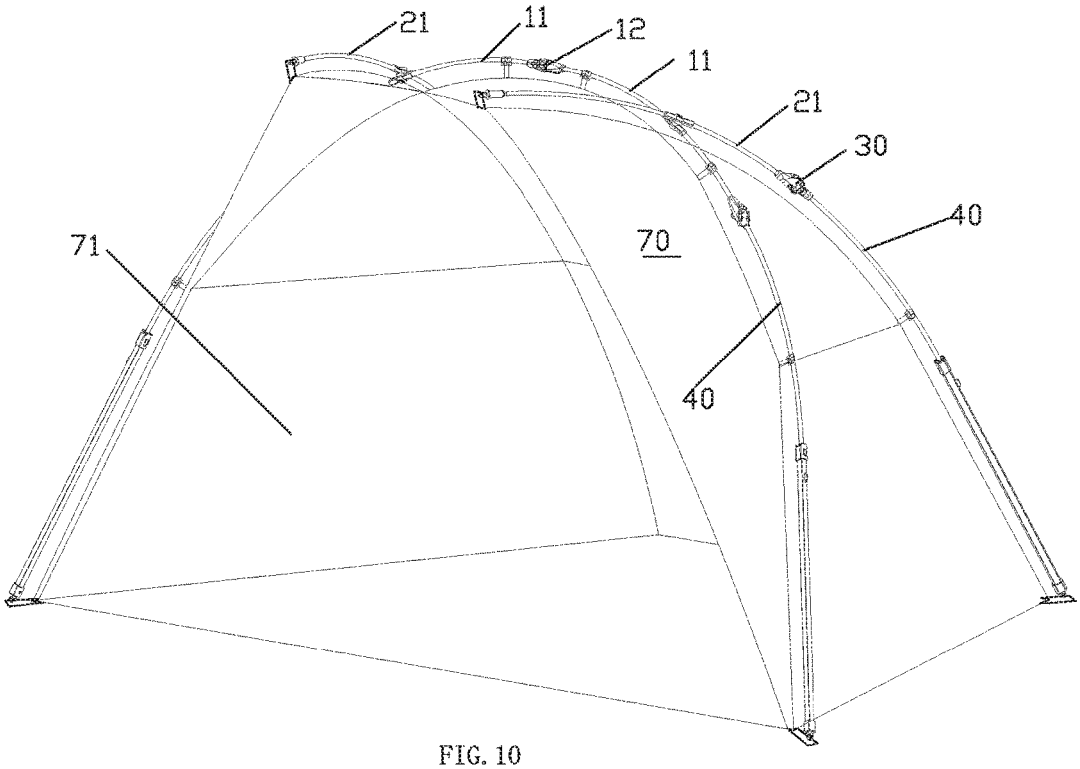
FIG. 10 illustrates a front view of a tent applied with the tent rack of Embodiment 1.
Figure 11:
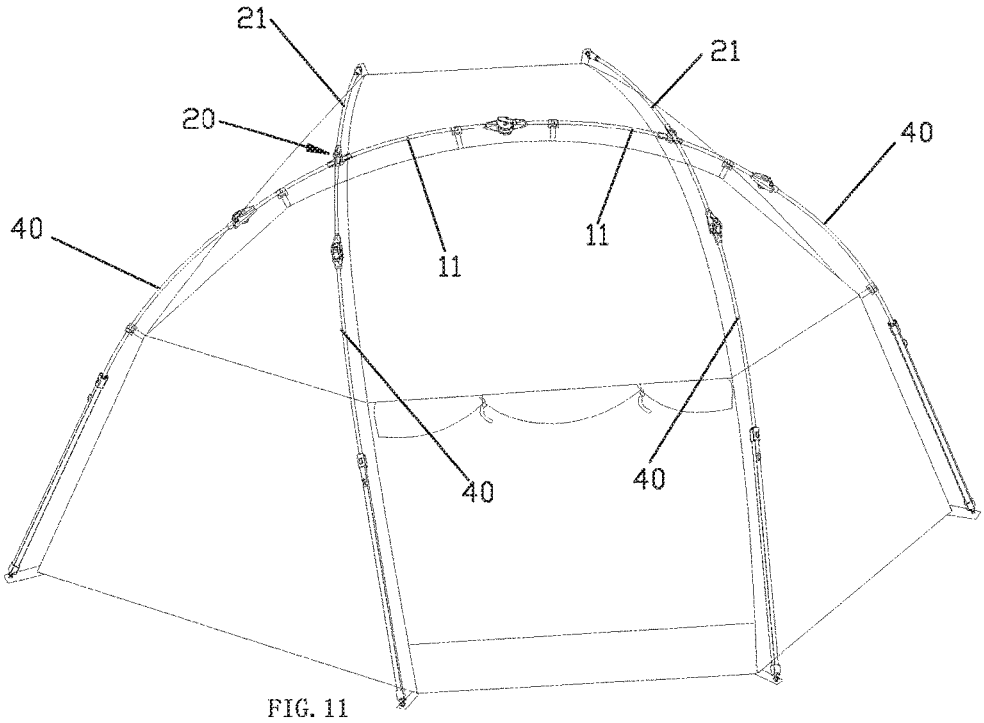
FIG. 11 illustrates a back view of the tent applied with the tent rack of Embodiment 1.

FIGS. 1-9 illustrate the folding process of the tent rack, but not limited to this, as needed, users can fold the tent rack according to their habits, the first stand pole and the leg pole rotate up and down to unfold and fold, for example, the first stand pole and the leg pole are rotated from up to down to unfold, the two first stand poles are rotated laterally to unfold or fold, one is vertically rotating, the other one is laterally rotating, the rotating directions differ in 90°. FIG. 10 and FIG. 11 illustrates the tent rack applied in a tent. The tent cloth 70 hangs to the tent rack, as the first end of the two second stand pole are suspending, this position corresponds to the door 71 of the tent cloth, the first end of the two second stand poles are connected to the two top corners of the door of the tent cloth 70. The tent rack and the tent cloth are integrally configured that the folding and unfolding are convenient and fast.

Embodiment 2

Figure 12:
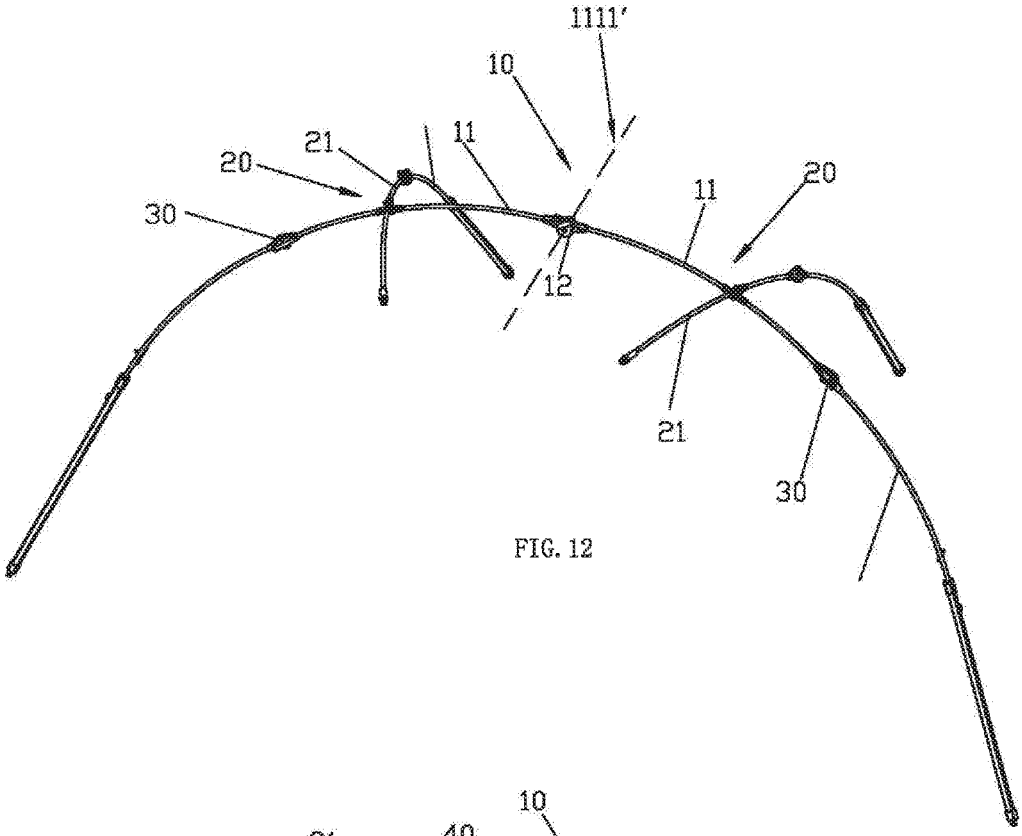
FIG. 12 illustrates a schematic diagram of the tent rack of Embodiment 2 in unfolding state.

This embodiment differs from Embodiment 1 in that: referring to FIG. 12, the rotating axis of the two first stand poles 11 in unfolding position is laterally disposed. The two first stand poles are rotatably up and down to achieve unfolding and folding, the first stand pole and the leg pole are rotated up and down to achieve unfolding and folding, for example, the first stand pole and the leg pole are rotated from up to down to achieve unfolding. The rotating directions differ in 180°.

Embodiment 3

Figure 13:
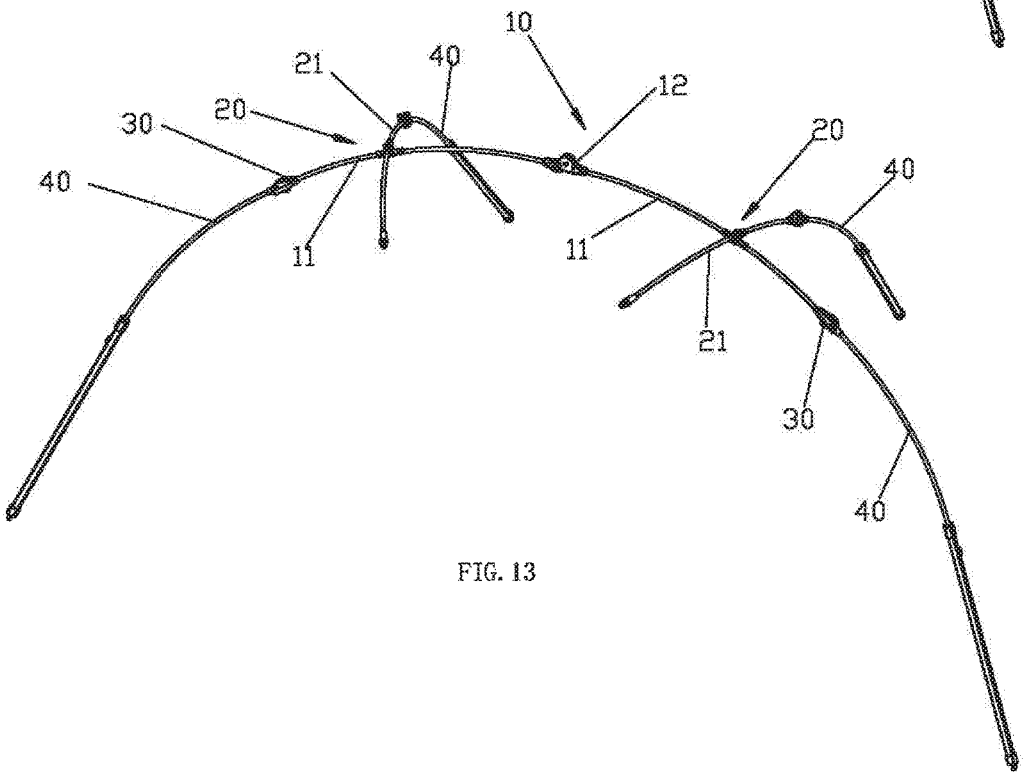
FIG. 13 illustrates a schematic diagram of the tent rack of Embodiment 3 in unfolding state.

This embodiment differs from Embodiment 2 in that: referring to FIG. 13, the two first stand poles are rotatable up and down to achieve unfolding and folding, for example, the two first stand poles are rotated from down to up to achieve unfolding; the first stand pole and the leg pole are rotatable up and down to achieve unfolding and folding, for example, the first stand pole and the leg pole are rotated from down to up to achieve unfolding. The rotating directions are the same.

Embodiment 4

Figure 14:
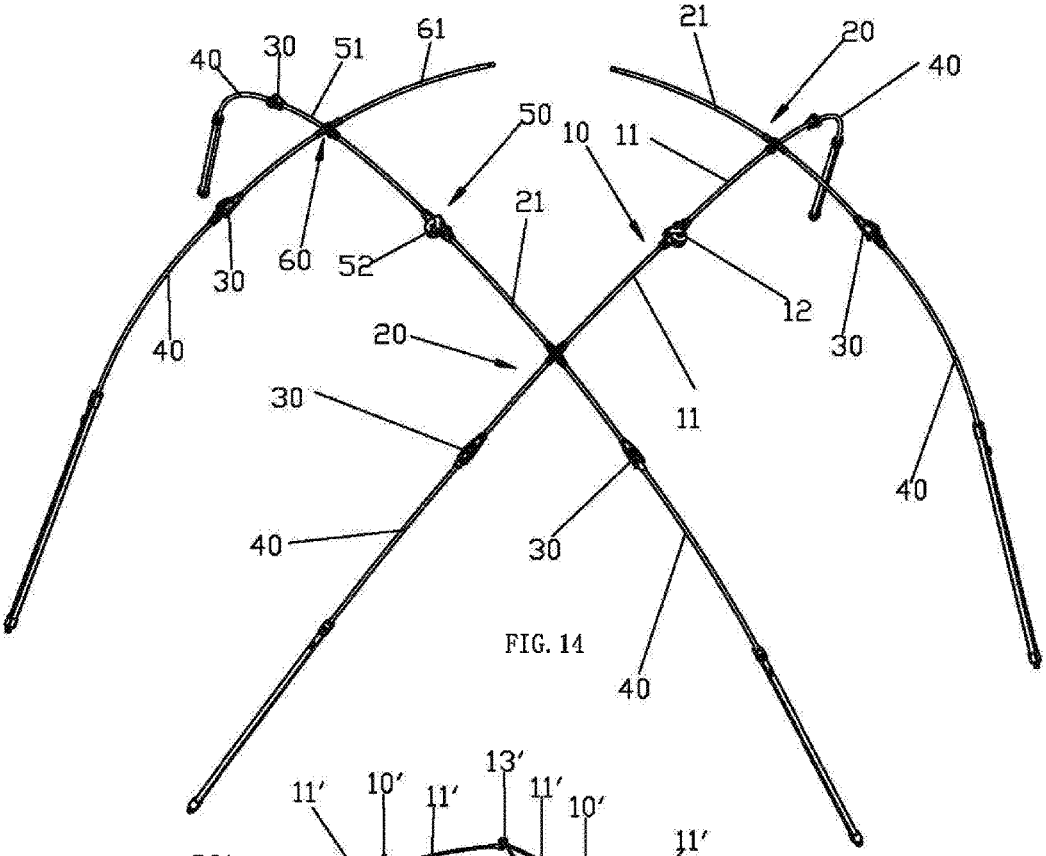
FIG. 14 illustrates a schematic diagram of the tent rack of Embodiment 4 in unfolding state.
Figure 15:
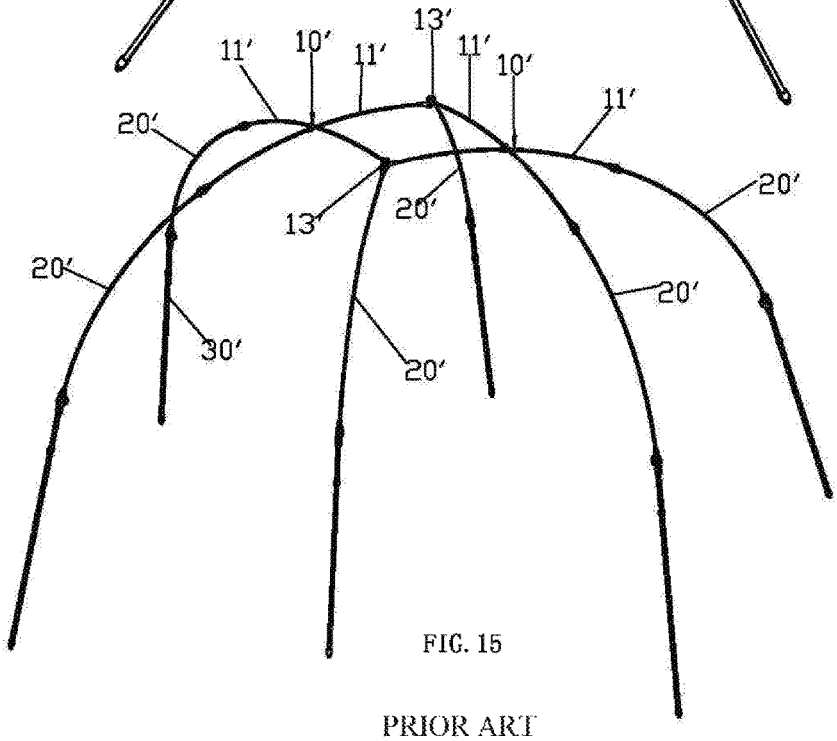
FIG. 15 PRIOR ART
FIG. 15 illustrates a schematic diagram of the tent rack of traditional technology in unfolding state.

This embodiment differs from Embodiment 1 in that: referring to FIG. 14, the tent rack further comprises a second support stand 50, which comprises a third stand pole 51, a second connecting base 52 and above mentioned second stand pole 21; the first end of the third stand pole 51 is rotatably connected to the first end of the second stand pole 21 by the third connecting base and they are rotatable in a unfolding position and a folding position. A fourth stand pole 61 is rotatably connected to the third stand pole 51, the third stand pole 51 and the fourth stand pole 61 are coupled to form a scissor-type structure 60; the second support stand 50 with the third stand pole 51 and the second stand pole 21 in unfolding position is arch shaped and the first stand pole 11 is separated from the fourth stand pole 61. The first end of the fourth stand pole 61 is suspending. In this embodiment, there is only one second support stand, another second support stand is available as needed to couple to another second stand pole.

The second end of the first stand pole 11, the second end of the second stand pole 21, the second end of the third stand pole 51 and the second end of the fourth stand pole 61 are rotatably connected with a leg pole 40 by a connecting member 30.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A tent rack, comprising:

a first support stand including a first connecting base; two first stand poles; and two second stand poles; and a second support stand 50 including a third stand pole; a second connecting base; and one second stand pole of the two second stand poles, wherein each first stand pole of the two first stand poles has a first end that is rotatably connected to the first connecting base so that the two first stand poles are rotatable between a folded position and an unfolded position, wherein each first stand pole of the two first stand poles is rotatably connected to and coupled with one second stand pole of the two second stand poles to form a scissor-type structure, and wherein the first support stand with the two first stand poles unfolded has an arch shape and the two second stand poles are separated from one another wherein one second stand pole of the two second stand poles and the third stand pole have respective first ends, and the first end of the third stand pole and the first end of the one second stand pole are rotatably connected by the second connecting base, wherein the third stand pole and the one second stand pole are rotatable between an unfolded position and a folded position, wherein the third stand pole is rotatably connected to and coupled with a fourth stand pole to form a scissor-type structure, and wherein the second support stand, the third stand pole, and the one second stand pole in the unfolded position form an arch shape and one first stand pole of the two first stand poles and the fourth stand pole are separated from one another.

2. The tent rack according to claim 1, wherein each first stand pole of the two first stand poles has an axis of rotation and the respective second stand pole of the two second stand poles extends in a direction that is not parallel to said axis of rotation.

3. The tent rack according to claim 2, wherein another second stand pole of the two second stand poles has a first end that is suspended.

4. The tent rack according to claim 1, wherein each first stand pole of the two first stand poles has an axis of rotation that extends vertically when the two first stand poles are in the unfolded position.

5. The tent rack according to claim 4, wherein another second stand pole of the two second stand poles has a first end that is suspended.

6. The tent rack according to claim 1, wherein each first stand pole of the two first stand poles has an axis that extends laterally when the two first stand poles are in the unfolded position.

7. The tent rack according to claim 6, wherein another second stand pole of the two second stand poles has a first end that is suspended.

8. The tent rack according to claim 1, wherein each second stand pole of the two second stand poles has a first end and the respective first ends are suspended.

9. The tent rack according to claim 1, further comprising a plurality of connecting members, and a plurality of leg poles, wherein the first stand pole and the second stand pole have respective second ends that are rotatably connected to one leg pole of the plurality of leg poles via one connecting member of the plurality of connecting members.

10. The tent rack according to claim 9, wherein each leg pole of the plurality of leg poles is a retractable pole that retracts.

11. The tent rack according to claim 1, wherein the fourth stand pole has a first end that is suspended.

12. The tent rack according to claim 1, further comprising a plurality of connecting members; and a plurality of leg poles, wherein the first stand pole, the second stand pole, the third stand pole, and the fourth stand pole have respective second ends that are rotatably connected to one leg pole of the plurality of leg poles via one connecting member of the plurality of connecting members.

13. The tent rack according to claim 12, wherein the leg pole is a retractable pole that retracts.

* * * * *